US006431248B1

(12) United States Patent
Hyman et al.

(10) Patent No.: US 6,431,248 B1
(45) Date of Patent: Aug. 13, 2002

(54) RELEASABLE CORD CONNECTION APPARATUS

(75) Inventors: James J. Hyman, Los Angeles, CA (US); Robert S. LeBlanc, Powder Springs, GA (US)

(73) Assignee: Lewis Hyman, Inc., Carson, CA (US)

( * ) Notice: Subject to any disclaimer, the term of this patent is extended or adjusted under 35 U.S.C. 154(b) by 0 days.

(21) Appl. No.: 09/706,052

(22) Filed: Nov. 3, 2000

(51) Int. Cl.[7] ..... E06B 9/30
(52) U.S. Cl. ..... 160/178.1 R; 160/243
(58) Field of Search ..... 160/178.1 R, 178.1 V, 160/173 R, 173 V, 243, 405

(56) References Cited

U.S. PATENT DOCUMENTS

| | | | | | |
|---|---|---|---|---|---|
| 1,301,603 | A | * | 4/1919 | Rathbun | 160/243 |
| 2,631,661 | A | * | 3/1953 | Nelson | 160/243 X |
| 3,246,685 | A | * | 4/1966 | Anderson et al. | 160/243 X |
| 4,603,725 | A | * | 8/1986 | Knight | 160/243 |
| 4,909,298 | A | * | 3/1990 | Langhart et al. | 160/178.1 R |
| D364,984 | S | | 12/1995 | Voss | D6/581 |
| 5,485,875 | A | * | 1/1996 | Genova | 160/178.1 R X |
| 5,494,092 | A | | 2/1996 | Georgopoulos | 160/178.1 |
| 5,518,056 | A | | 5/1996 | Voss et al. | 160/178.1 |
| 5,553,653 | A | * | 9/1996 | Rozon | 160/178.1 R X |
| 5,560,414 | A | * | 10/1996 | Judkins et al. | 160/178.1 R |
| 5,562,140 | A | | 10/1996 | Biba | 160/178.1 |
| 5,577,543 | A | | 11/1996 | Jelic | 160/178.1 |
| 5,634,244 | A | | 6/1997 | Fetsch et al. | 24/225 F |
| 5,715,884 | A | | 2/1998 | Cotton | 160/178.1 |
| 5,722,478 | A | * | 3/1998 | Claypool et al. | 160/173 R |
| D405,352 | S | | 2/1999 | Rosenbauer | D8/382 |
| 5,906,233 | A | | 5/1999 | May | 160/178.1 |
| 5,971,054 | A | | 10/1999 | Gobidas | 160/178.1 |
| 5,987,709 | A | | 11/1999 | Chou | 24/116 A |
| 6,044,523 | A | | 4/2000 | Ortega | 16/442 |

* cited by examiner

*Primary Examiner*—David M. Purol
(74) *Attorney, Agent, or Firm*—Oppenheimer Wolff & Donnelly LLP; Spyros J. Lazaris

(57) ABSTRACT

A releasable cord connector apparatus includes a receptive member and a connective member that inserts into the receptive member and releases when a force is applied. The receptive member couples to a headrail and has a recess into which the connective member inserts. The connective member is also attached to a cord which is used to raise or lower a window covering. The connective member releases from the recess of the receptive member when a child or pet becomes entangled in the cord.

16 Claims, 2 Drawing Sheets

RELEASABLE CORD CONNECTION APPARATUS

BACKGROUND OF THE INVENTION

This invention relates generally to indoor and outdoor window coverings such as venetian blinds and roll up shades. More particularly, the invention relates to releasable breakaway safety devices used with looped cords on window coverings for preventing injury.

DESCRIPTION OF THE RELATED ART

Window coverings, or blinds, typically have a horizontal or vertical covering to prevent sunlight from entering an area and to retain privacy. The covering, which is commonly in the form of slats or pleats, can hang vertically in the case of a vertical covering, or can extend horizontally from a headrail in the case of a horizontal covering. Many window coverings also include a bottom rail as well.

In order to raise and lower the bottom rail relative to the floor, a looped cord extends from a point along the bottom rail through the slats and into the headrail. Two or more cords are often provided to raise or lower the blind system evenly. The covering is raised or lowered by pulling or releasing the accessible portion of the cords. Because all cords must move in unison, they are typically joined together at an accessible place and then finished with two tassels. Single cords and multiple cords that end up at the tassel without being separated present a danger to children and pets because they can become entangled in the cords and suffocate or accidentally hang themselves. However, all tassels must now be separated by recommendation of the Window Covering Safety Council.

The prior art presents several attempts to minimize or eliminate the possibility of entanglement in the cords. In U.S. Pat. No. 5,577,543, a child safety device in a tassel is disclosed. The device includes a cutting means to cut cords, such as a blade, in case a person becomes entangled. However, the tassel may drop to the floor and become damaged, causing the blade to protrude from the tassel. Also, the detached tassel could be placed in a child's mouth, resulting in choking and possibly death.

In U.S. Pat. No. 6,044,523, a breakaway tassel is disclosed. In this device all the cords except one can break away from the tassel when a force is applied to the cords. However, it is still possible for the tassel to be inserted into the mouth. The non-breakaway cord can be used to pull the tassel from the mouth of an infant. However, the tassel still poses a threat if it is not removed in a timely manner. Furthermore, the process of removing the tassel may damage the throat and/or the sensitive lining in the mouth of an infant.

In U.S. Pat. No. 5,562,140 a releasable operating cord connector is disclosed. This connector is part of a tassel that detaches from the cords when a force is applied to the cords, thereby causing the tassel to drop to the floor. However, an infant can pick up the tassel and insert it into the mouth, thereby causing suffocation and possible death.

Therefore, there is a need in the art for an apparatus that reduces the dangers associated with cords on window blinds.

SUMMARY OF THE INVENTION

The present invention provides a releasable cord connection apparatus having a breakaway safety clip that eliminates or reduces the risk of strangulation or choking from cords of devices such as window coverings.

A window covering has a releasable cord connection safety apparatus that is connected to a headrail. The apparatus has a receptive member and a connective member releasably coupled to each other. The receptive member is coupled to the headrail, and the connective member is coupled to a cord. In addition, the cord may be connected to a tassel.

In one aspect of the invention, the receptive member has a deformable first end. The receptive member is coupled to the headrail by fitting the deformable first end over a hanging mechanism. The receptive member also includes a second end having a recess. The connective member is releasably inserted into the recess of the receptive member to couple the receptive member and connective member together. When an excessive force is applied to the cord, the connective member releases from the receptive member.

It is therefore an object of the invention to provide a method and apparatus for releasably coupling a cord for a window covering that detaches when force is applied to the cord.

It is also an object of the invention to provide a safety device to prevent children and pets from becoming entangled in a cord for a window covering.

It is further an object of the invention to provide a method and apparatus for releasably coupling a cord for a window covering that is easily re-attachable if it is detached.

DETAIL DESCRIPTION OF THE EMBODIMENTS

Figure 1:
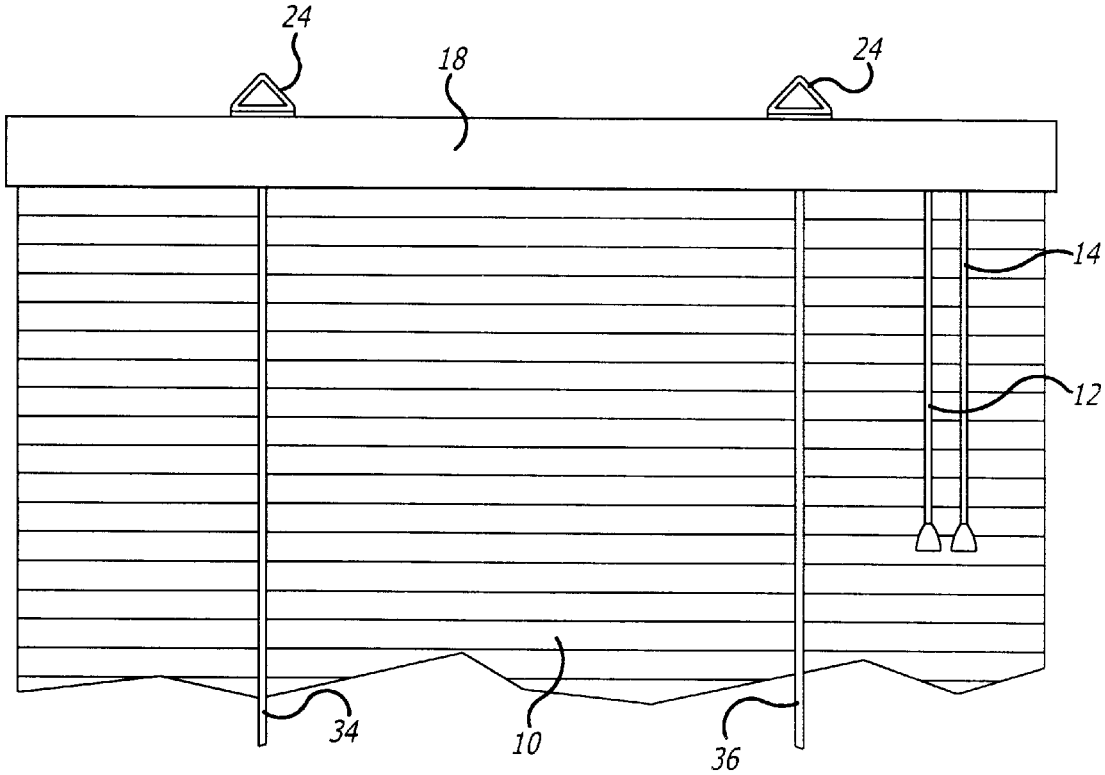
FIG. 1 is a front view of the releasable cord connection apparatus.

FIG. 1 is a front view of a releasable cord connection apparatus and window covering. The releasable cord connection apparatus has a window covering 10 and a looped cord system having two looped cords and two pull cords. The looped cords include a first looped cord 34 and a second looped cord 36, and the pull cords include a first pull cord 12 and a second pull cord 14. When the window covering 10 is in a rolled up position, the cords 12, 14, 34 and 36 can easily be reached by children or pets. A first end of each pull cord 12 and 14 connects to a tassel. In one embodiment, multiple tassels can be used for multiple cords, and the multiple tassels can be tied together into a common tassel for uniform lift action. The window covering 10 may be a window blind with horizontal or vertical slats, or it may have a roll-up portion made of polyvinyl chloride, bamboo, or any other material commonly used to make roll-up window coverings.

Figure 2:
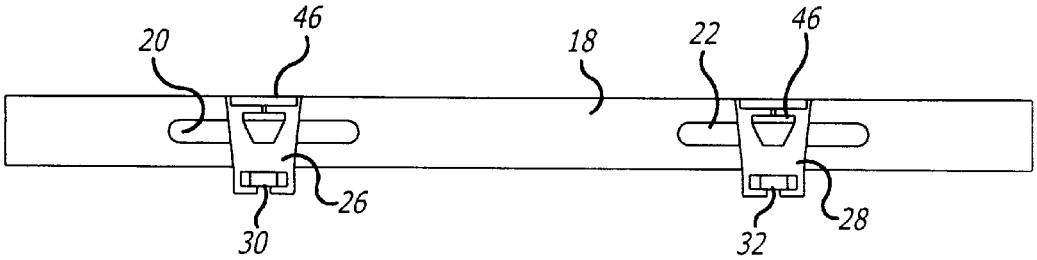
FIG. 2 is a top view of a headrail showing the releasable cord connection apparatus.

FIG. 2 is a top view of the headrail 18. The headrail 18 includes a first slot 20 and a second slot 22. Each slot holds a hanging mechanism 24 that slides in a linear manner in each slot. This allows a person to align each hanging mechanism for connection to a wall or window portion. FIG. 2 also shows a first receptive member 26 and a second receptive member 28. Each receptive member 26 and 28 has a first section that is configured to fit over the hanging mechanism 24 to removably couple to the headrail. In one embodiment, the first section is deformable so that it is able to stretch and fit over the hanging mechanism. In another embodiment, the first section includes a slot that is wide enough to fit over the hanging mechanism. FIG. 2 also shows a top of a first connective member 30 and a top of a second connective member 32, each of which is releasably inserted into a respective receptive member.

Figure 3:
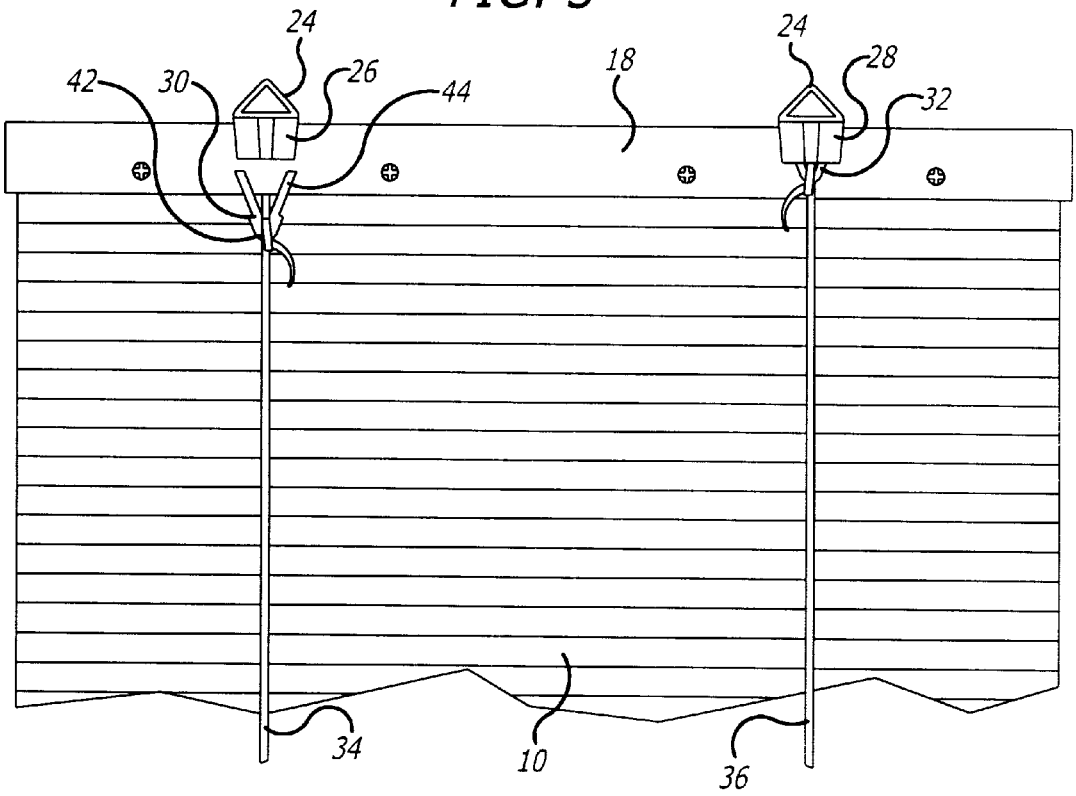
FIG. 3 is a rear view of the releasable cord connection apparatus.

FIG. 3 is a rear view of the releasable cord connection apparatus. FIG. 3 shows the first receptive member 26 and the second receptive member 28 coupled to the headrail 18. In the embodiment shown in FIG. 3, the first receptive member 26 and the second receptive member 28 are coupled such that they are positioned on the top and down a back side of the headrail 18. Although FIG. 3 shows two receptive members, it is to be understood that the invention also contemplates that any number of receptive members could be coupled to the headrail 18. Further, the receptive members may be either fixedly coupled to the headrail, or they may be removably coupled. One example of the receptive members being removably coupled to the headrail 18 is shown in FIG. 2, where each receptive member has a first deformable end that fits over each hanging mechanism. In another embodiment in which the receptive members are fixedly coupled, the receptive members may be bolted or screwed to the headrail 18 such that they are permanently coupled to the headrail 18.

FIG. 3 also shows the first connective member 30 and the second connective member 32. Each connective member 30 and 32 is configured to be releasably inserted into a receptive member. Each connective member 30 and 32 is also coupled to a cord. FIG. 3 shows a first cord 34 coupled to the first connective member 30 and a second cord 36 coupled to the second connective member 32. The cords 34 and 36 may be releasably coupled to the connective members 30 and 32 by tying an end of each cord through a semi-arcuate end 42 of each connective member 30 and 32. Although FIG. 3 shows two connective members and two cords, it is to be understood that any number of connective members can be used to releasably insert into a corresponding number of receptive members, and also that a corresponding number of cords may also couple to the connective members.

The first connective member 30 is shown in FIG. 3 as being released from the first receptive member 26. In contrast, the second connective member 32 is shown releasably inserted into the second receptive member 28. Each receptive member 26 and 28 includes a recess 38 at a second end 40. Each connective member 30 and 32 also includes a semi-arcuate end 42 and two elongate pieces 44 extending out from the semi-arcuate end 42. In a released position, the two elongate pieces 42 are angled apart from each other, with the distance between the pieces increasing as they move farther away from the semi-arcuate end 40.

Each connective member 30 and 32 is sufficiently large so as not to be easily inserted into the mouth of a child after release from a receptive member. Furthermore, each connective member 30 and 32 has a smooth surface with no jagged, sharp or protruding edges that could injure a child if placed in the mouth.

The receptive members 26 and 28 and the connective members 30 and 32 may be made of any plastic material capable of withstanding prolonged exposure to heat so that the receptive members do not melt or become brittle. The plastic material used should also be able to slightly deform so that, for example, a receptive member would be able to receive a connective member and hold it in place. In one embodiment, the plastic material used to make the receptive and connective members is polypropylene. In this embodiment, the polypropylene material in the receptive members 26 and 28 provides sufficient elasticity to allow the receptive members 26 and 28 to expand and fit around each hanging mechanism 24 and then return to an original shape. Similarly, the polypropylene material allows the two elongate pieces 42 to bend inward and then expand to close to an original shape once inside the recess. Polypropylene therefore represents one example of a plastic material that can be used to make the receptive and connective members. In another embodiment, the receptive and connective members are made of acrylonitrile butadiene styrene, also known as ABS.

The receptive members and/or connective members may also be made of a metallic material. Metallic materials used should be capable of allowing a connective member to releasably insert into the receptive member, and should also have a sufficient degree of strength to provide a sturdy coupling that is not easily broken. The receptive and connective members do not have to be made of the same material. Therefore, in one embodiment, the receptive member is made of a metallic material, and the connective member is made of plastic material, with the plastic material being releasably insertable into the metallic material.

Figure 4:
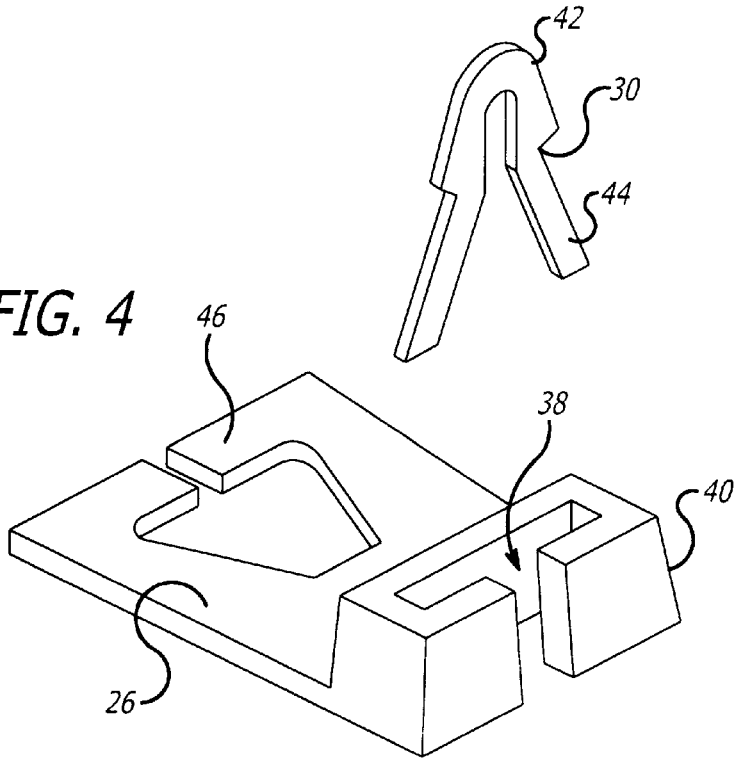
FIG. 4 is a perspective view of the receptive and connective components of the releasable cord connection apparatus.

FIG. 4 is a perspective view of a receptive member and a connective member. The receptive member includes a deformable first end 46 and the second end 40 having the recess 38. The second end 40 having the recess 38 is positioned to be perpendicular to the deformable first end 46. This allows the receptive member to be positioned along the top and back side of a headrail 18 to provide an aesthetically pleasing appearance to the window covering having the releasable cord connection apparatus.

The connective member includes the semi-arcuate end 42 and the two elongate pieces 44 extending away from the semi-arcuate end 42. The two elongated pieces 44 are releasably insertable into the recess 38 of the receptive member by pinching the two elongate pieces 44 toward each other and inserting the two elongate pieces 44 into the recess 38. Once inside the recess 38, the two elongate pieces 44 move outward and hold the connective member inside the recess 38 by exerting force against the second end 40. When a force is applied to a cord coupled to the connective member, the two elongate pieces 44 are pinched inward by the walls of the second end 40 as a downward force is exerted on the connective member. As a result, the two elongate pieces 44 deform and release from the recess 38. After release, the connective member is easily re-insertable into the recess 38 by pinching the two elongate pieces 44 together and inserting into the recess 38.

The apparatus is designed such that the connective member releases from the receptive member when a force is applied to a cord. The apparatus is designed to protect small pets and infants weighing from about 10 pounds and large pets or children weighing under 100 pounds from becoming strangling in the cord or cords. At the same time, the apparatus is designed such that a relatively small force applied to the cords, such as for example when the cord is lightly pulled, does not cause the connective member to release from the receptive member. Similarly, the apparatus is also designed such that a rapid application of force to the cord, such as for example when a person rapidly pulls the cord to raise or lower the blinds, also does not cause the connective member to release from the receptive member. Therefore, the apparatus is designed such that any force sufficient to cause strangulation or other injury to pets or children will cause the connective member to release from the receptive member.

The apparatus is also designed to break away under varying forces depending on the size of window covering to which the apparatus is applied. Larger or wider window coverings require the application of a greater force to raise or lower the covering than small window coverings. As a result, for a larger window covering, the application of a light force that might cause the release of the connective member in a smaller window covering would not cause a break away response in the larger window covering. However, despite the differences in forces needed to raise and lower the window covering, the apparatus is nevertheless designed to cause the release of the connective member from the receptive member when any force sufficient to cause strangulation or other injury to pets or children is applied.

The foregoing description of the embodiments of the invention have been presented for the purposes of illustration and description. It is not intended to be exhaustive or to limit the invention to the precise form disclosed. Many modifications and variations are possible in light of the above teaching. For example, the releasable cord connector safety apparatus can be included within the cord. One end of the cord is connected to a tassel. The opposite end of the same cord has a first jack that is releasably coupled to a first socket of a coupling interface. A second socket of the coupling interface is releasably coupled to a second jack. The second jack is connected to a headrail by an additional cord. When an excessive force is applied to the cord having the first jack, the first jack disconnects from the coupling interface. Another example involves the material composition of the receptive and connective members. The material may be metal or any other material commonly used to releasably couple components. The shape and sizes of the receptive and connective members are also not limited to those shown and described in this specification. Other types of members that could be used to provide a releasable cord connection apparatus include a bolt and spring arrangement and magnetic apparatus in which two magnetic members releasable couple a cord to a headrail. It is intended that the scope of the invention be limited not by this detailed description, but rather by the claims appended hereto.

What is claimed is:

1. A releasable cord connection apparatus for a window covering, the apparatus comprising:

a plurality of receptive members coupled to a headrail, each receptive member having a recess;

a plurality of connective members each having a first end releasably inserted into a recess of one of said plurality of receptive members and a second end connecting to an end of a cord of a plurality of cords, each of said plurality of connective members releasing from said receptive members when a force is applied to the cord connecting to a respective connective member.

2. The apparatus of claim 1, wherein said plurality of connective members releasably insert into said recess of one of said plurality of receptive members.

3. The apparatus of claim 1, wherein said plurality of connective members are deformable.

4. The apparatus of claim 1, wherein said plurality of receptive members are fixedly coupled to said head rail.

5. The apparatus of claim 1, wherein said plurality of receptive members are removably coupled to said head rail.

6. The apparatus of claim 1, further comprising a tassel coupled to an end of each of said plurality of cords.

7. The apparatus of claim 1, further comprising a window covering connected to said head rail.

8. The apparatus of claim 1, wherein each of said plurality of connective members include a semi-arcuate section and a linear section having two elongate pieces, the two elongate pieces releasably inserting into said recess of one of said plurality of receptive members.

9. A releasable cord connection apparatus for a window covering, the apparatus comprising:

a first receptive member coupled to a headrail;

a second receptive member coupled to the headrail;

a first connective member having a first end releasably inserted into said first receptive member and a second end connected to a cord, the first connective member releasing from the first receptive member when a force is applied to said cord;

a second connective member having a first end releasably inserted into said second receptive member and a second end connected to a cord, the second connective member releasing from the second receptive member when a force is applied to said cord; and a recess disposed within said first receptive member and a recess disposed within said second receptive member.

10. The apparatus of claim 9, wherein said first connective member releasably inserts into said recess of said first receptive member, and said second connective member releasably inserts into said recess of said second connective member.

11. The apparatus of claim 9, wherein said first connective member is deformable.

12. The apparatus of claim 9, wherein said first receptive member is fixedly coupled to said headrail.

13. The apparatus of claim 9, wherein said first receptive member is removably coupled to said headrail.

14. The apparatus of claim 9, further comprising a tassel coupled to an end of said cord.

15. The apparatus of claim 9, further comprising a window covering connected to said headrail.

16. The apparatus of claim 9, wherein said first connective member includes a semi-arcuate section and a linear section having two elongate pieces, the two elongate pieces releasably inserting into said recess of said first receptive member.

* * * * *